US007909922B2

(12) United States Patent
Jang et al.

(10) Patent No.: US 7,909,922 B2
(45) Date of Patent: Mar. 22, 2011

(54) DEHUMIDIFIER

(75) Inventors: Duck-Yong Jang, Changwon-si (KR); Chi-Wao Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 143 days.

(21) Appl. No.: 11/988,099

(22) PCT Filed: Oct. 24, 2006

(86) PCT No.: PCT/KR2006/004346

§ 371 (c)(1),
(2), (4) Date: Dec. 30, 2008

(87) PCT Pub. No.: WO2007/049902

PCT Pub. Date: May 3, 2007

(65) Prior Publication Data

US 2009/0158934 A1 Jun. 25, 2009

(30) Foreign Application Priority Data

Oct. 24, 2005 (KR) ..... 10-2005-0100257
Jan. 24, 2006 (KR) ..... 10-2006-0007324

(51) Int. Cl.
*B01D 49/00* (2006.01)

(52) U.S. Cl. ..... 96/405; 55/423; 55/429; 55/467; 55/471; 55/472; 55/473; 55/434.2; 55/434.4; 95/24; 95/228; 96/408; 96/409; 96/423; 96/412; 96/417; 62/115; 62/119; 62/128; 62/271

(58) Field of Classification Search ..... 55/423, 55/429, 467, 471–473, 434.2–434.4; 96/408–412, 96/417, 423; 95/24, 228; 62/115, 119, 128, 271

See application file for complete search history.

(56) References Cited

U.S. PATENT DOCUMENTS

| | | | | | |
|---|---|---|---|---|---|
| 2,725,196 | A * | 11/1955 | Trittschuh | 236/44 A |
| 3,110,161 | A * | 11/1963 | Maleck | 62/188 |
| 4,135,370 | A * | 1/1979 | Hosoda et al. | 62/274 |
| 4,181,021 | A * | 1/1980 | Harris et al. | 73/317 |
| 4,554,794 | A * | 11/1985 | Khan | 62/150 |
| 4,712,382 | A * | 12/1987 | LeClear | 62/150 |
| 5,850,175 | A * | 12/1998 | Yeilding | 340/431 |
| 6,415,618 | B1 * | 7/2002 | Sul et al. | 62/188 |
| 6,471,739 | B2 * | 10/2002 | Eom | 55/471 |
| 7,244,294 | B2 * | 7/2007 | Kates | 96/417 |
| 7,303,611 | B2 * | 12/2007 | Bae et al. | 96/121 |
| 7,416,574 | B2 * | 8/2008 | Udagawa et al. | 55/356 |
| 7,731,785 | B2 * | 6/2010 | Choi et al. | 96/126 |
| 2004/0244398 | A1 * | 12/2004 | Radermacher et al. | 62/285 |
| 2006/0015974 | A1 * | 1/2006 | Ike | D23/359 |
| 2006/0032379 | A1 * | 2/2006 | Kates | 96/417 |

(Continued)

FOREIGN PATENT DOCUMENTS

CN 1584421 2/2005

(Continued)

*Primary Examiner* — Jason M Greene
*Assistant Examiner* — Dung Bui
(74) *Attorney, Agent, or Firm* — McKenna Long & Aldridge LLP

(57) ABSTRACT

A dehumidifier is provided. A dehumidifier includes a cabinet defining an outer appearance, a barrier installed in the cabinet to collect condensed water removed from air, a bucket assembly for storing the condensed water directed from the barrier, and a condensed water detecting unit for detecting an amount or level of the condensed water stored in the bucket assembly.

13 Claims, 14 Drawing Sheets

(a)

(b)

U.S. PATENT DOCUMENTS

| | | | | |
|---|---|---|---|---|
| 2006/0156927 | A1 * | 7/2006 | Udagawa et al. | 96/417 |
| 2007/0062370 | A1 * | 3/2007 | Ahn et al. | 95/115 |

FOREIGN PATENT DOCUMENTS

| | | | | |
|---|---|---|---|---|
| JP | 58140536 | A | * | 8/1983 |
| JP | 58158435 | A | * | 9/1983 |
| JP | 02275230 | A | * | 11/1990 |
| JP | 04158132 | A | * | 6/1992 |
| JP | 04203714 | A | * | 7/1992 |
| JP | 05126359 | A | * | 5/1993 |
| JP | 05196255 | A | * | 8/1993 |
| JP | 2001182966 | A | * | 7/2001 |
| KR | 10-2002-0042019 | | | 6/2002 |

* cited by examiner

[Fig. 1]
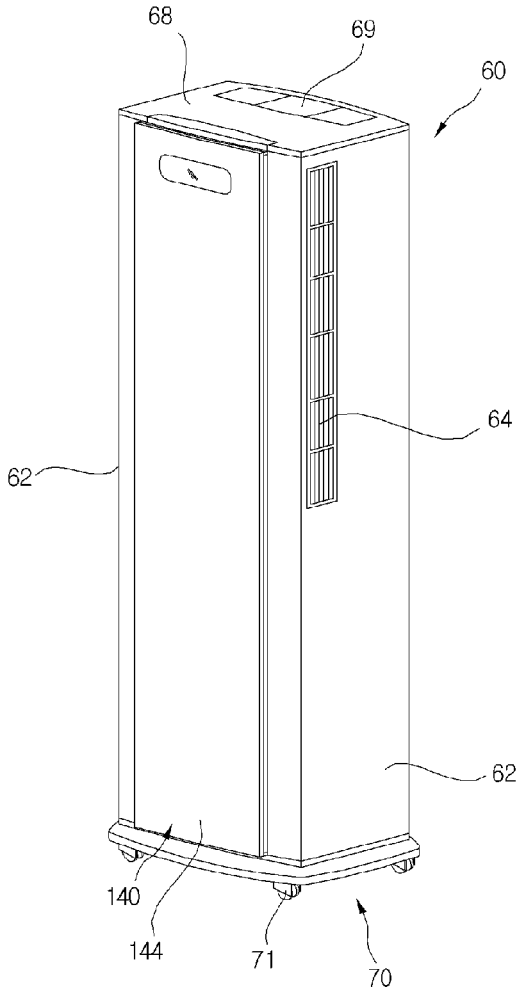
[Fig. 2]
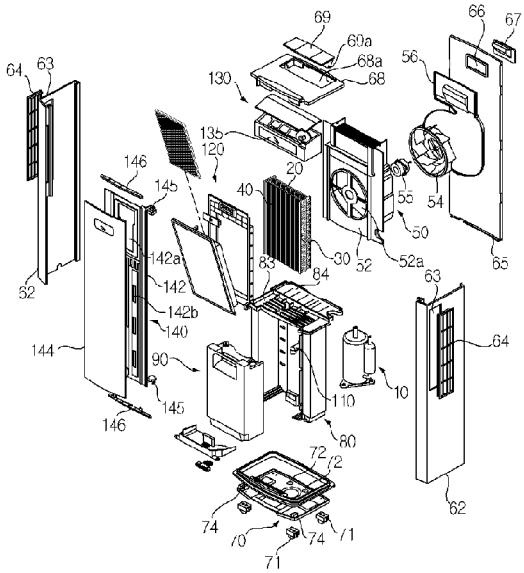

[Fig. 3]
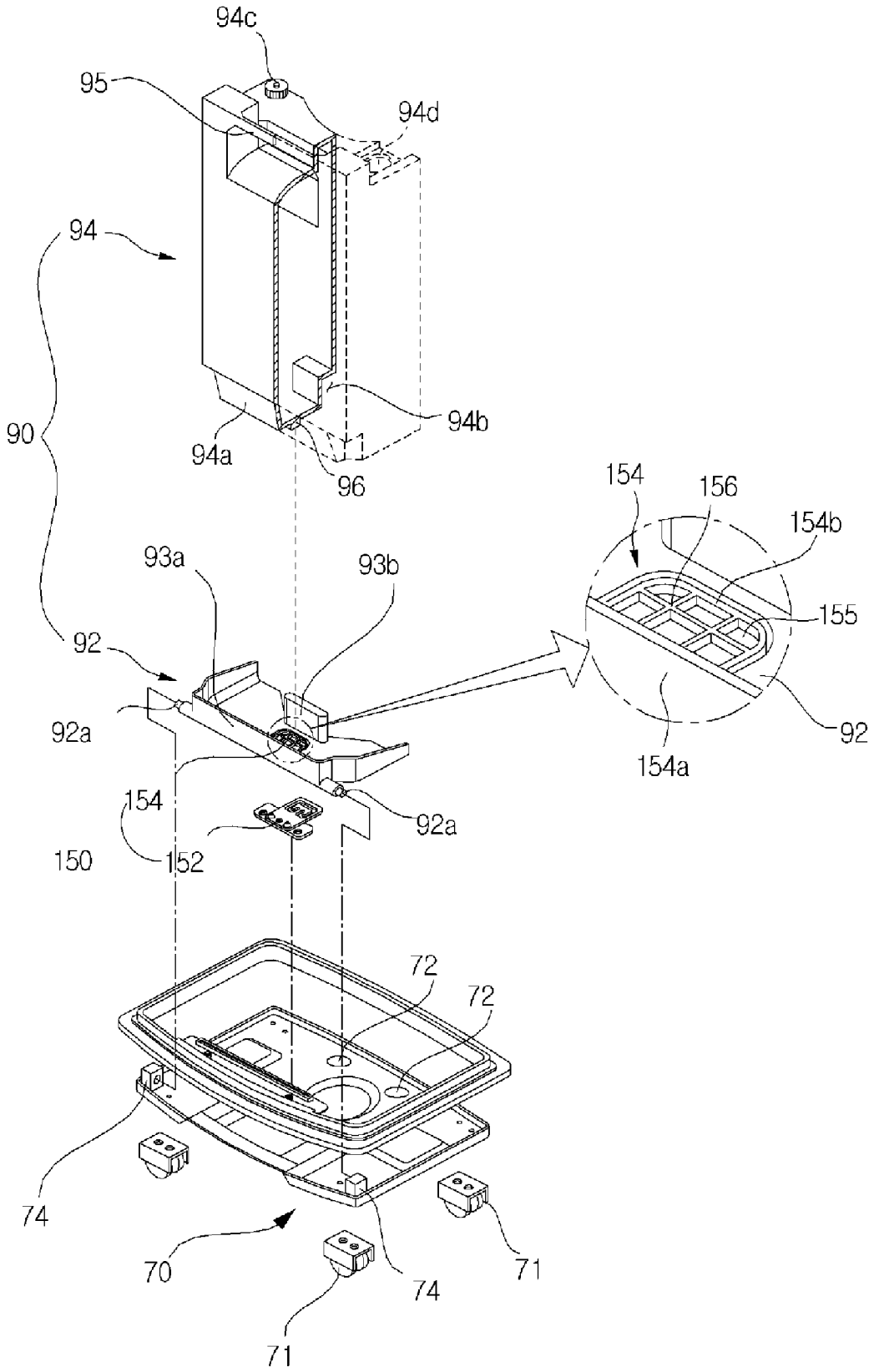

[Fig. 4]
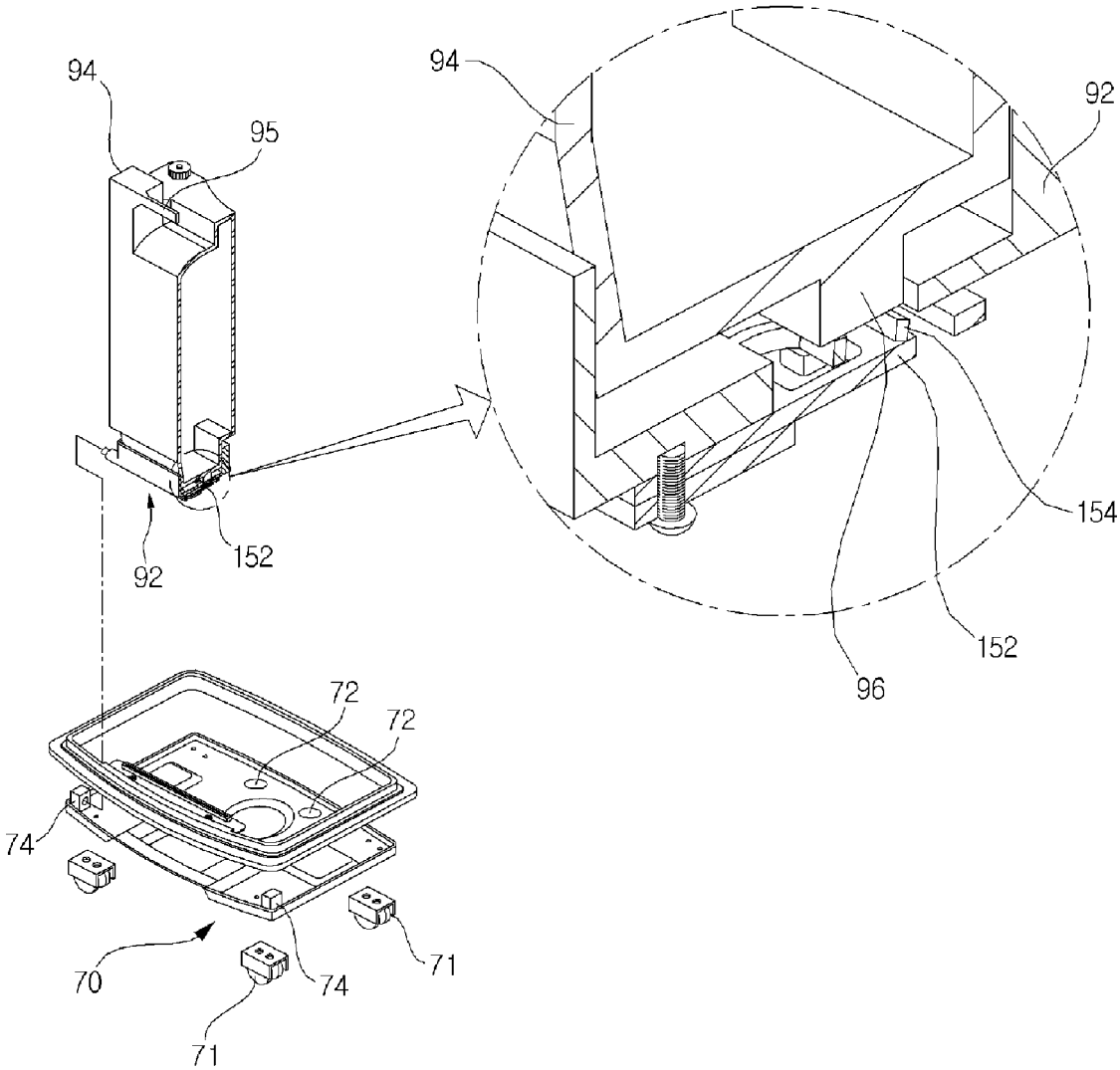
[Fig. 5]
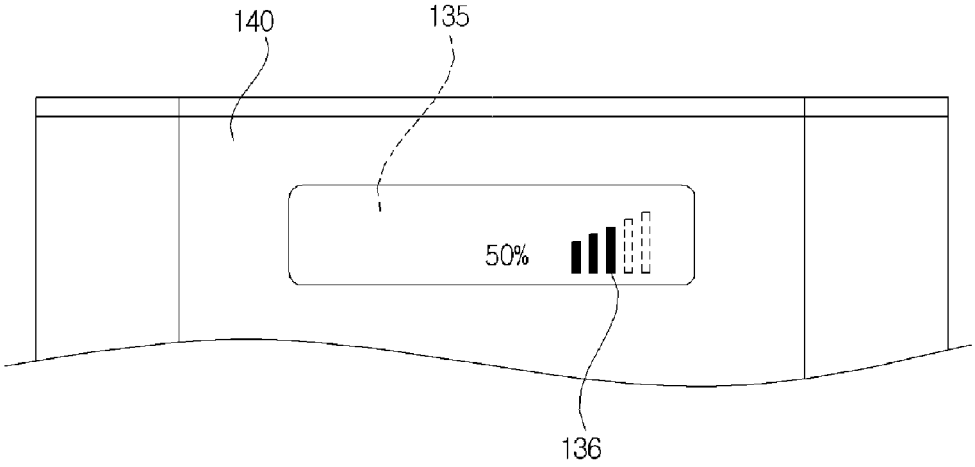

[Fig. 6]
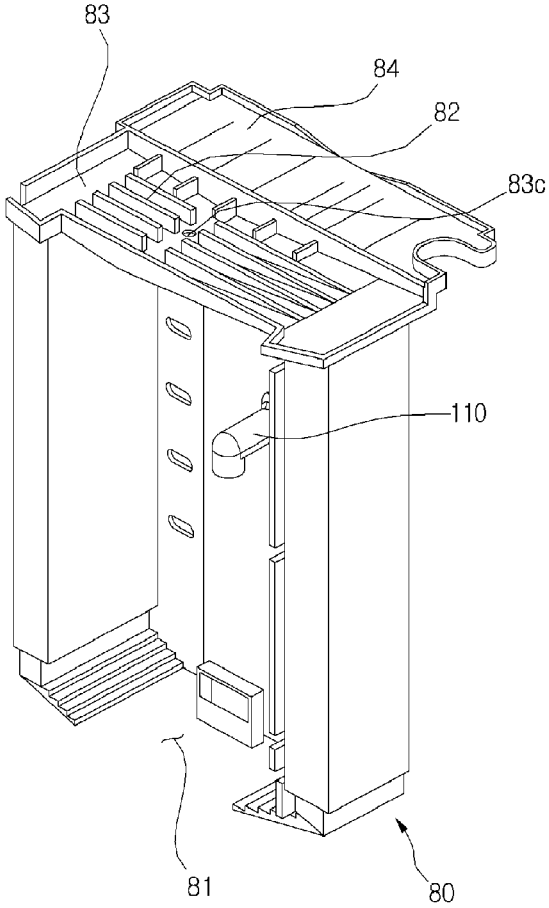
[Fig. 7]
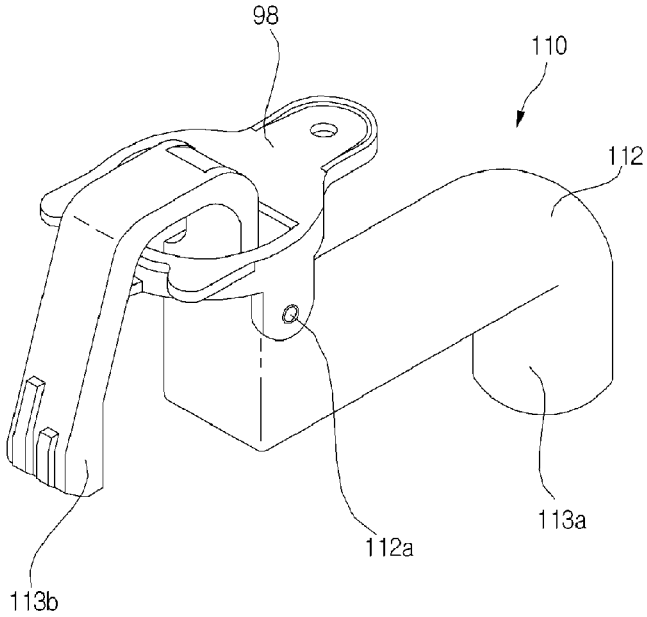

[Fig. 8]
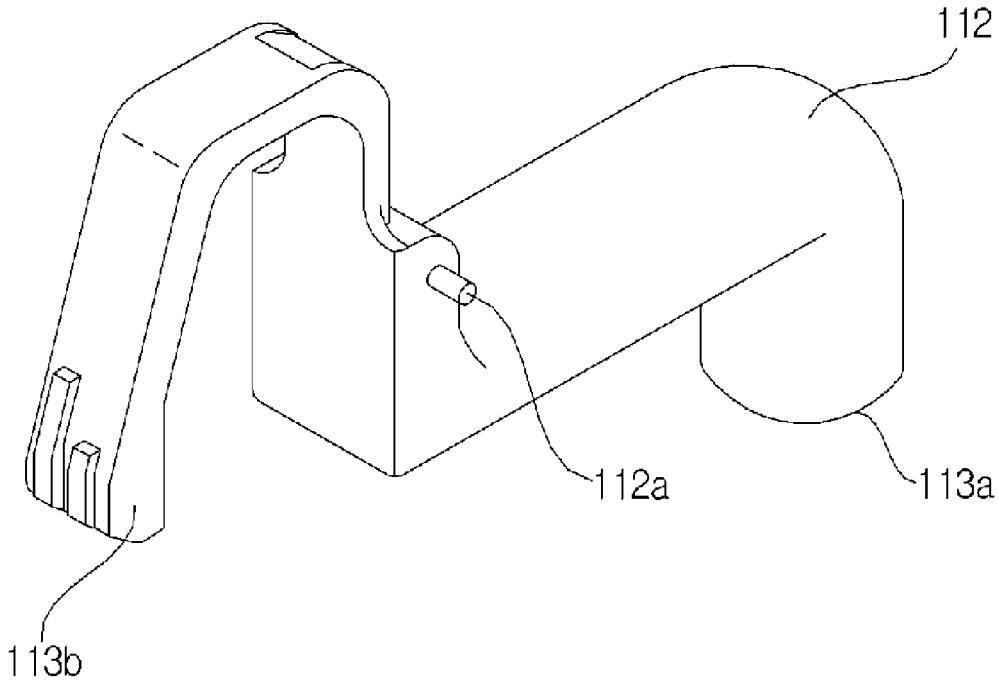
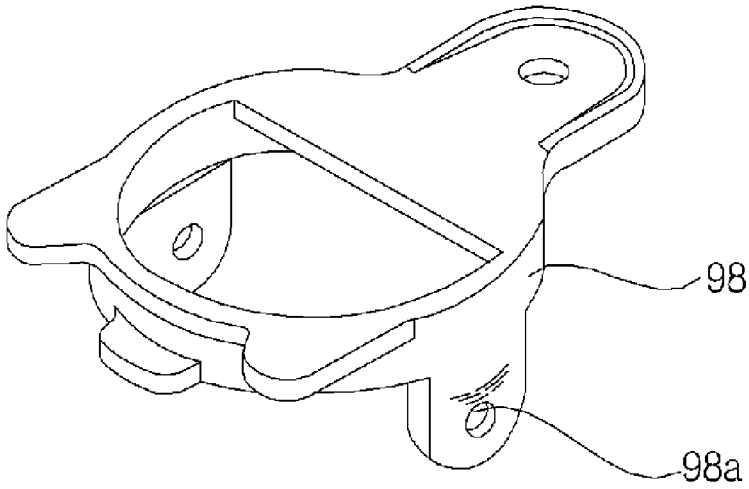

[Fig. 9]
(a)
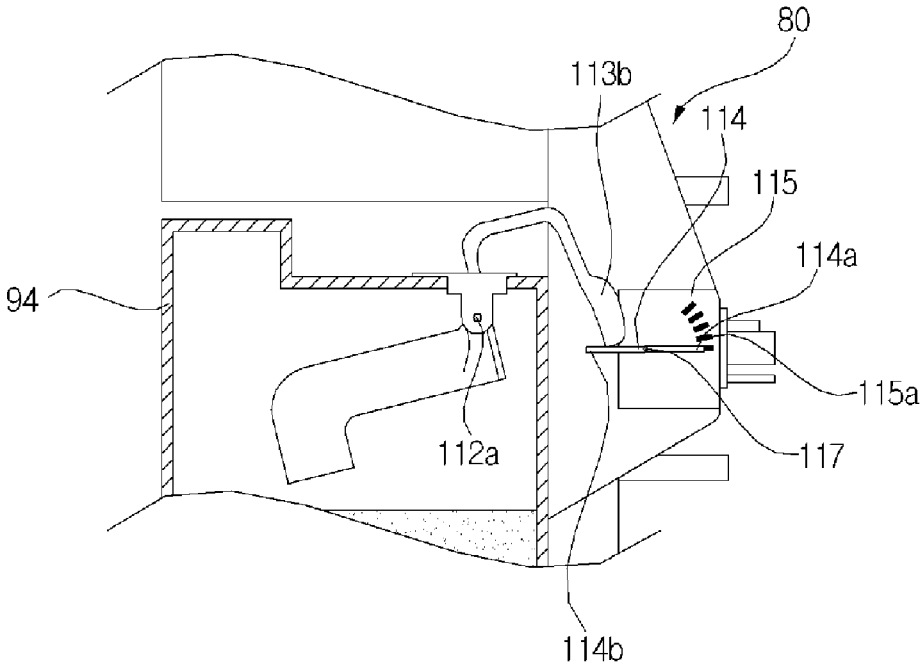
(b)
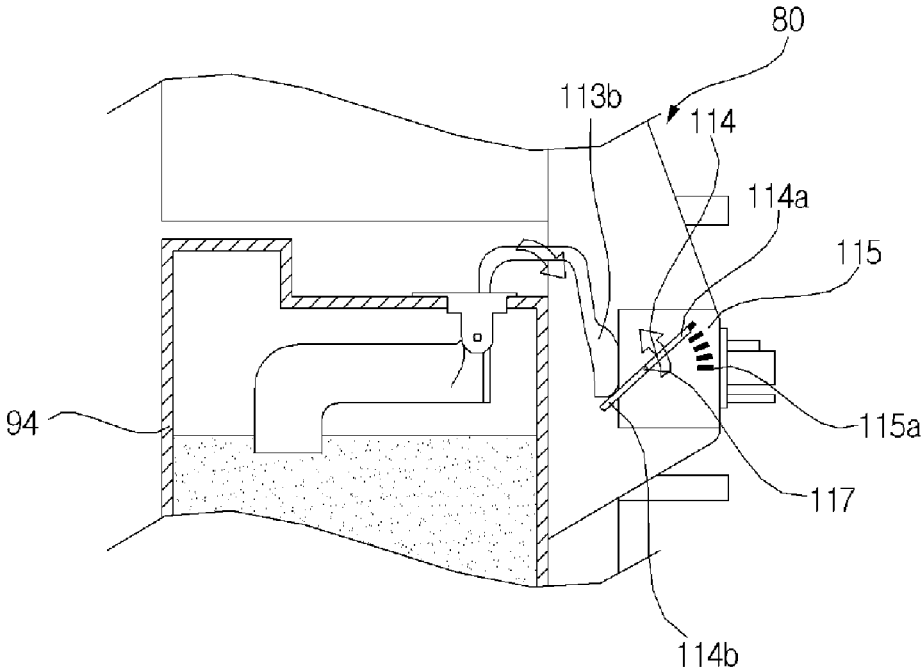

[Fig. 10]
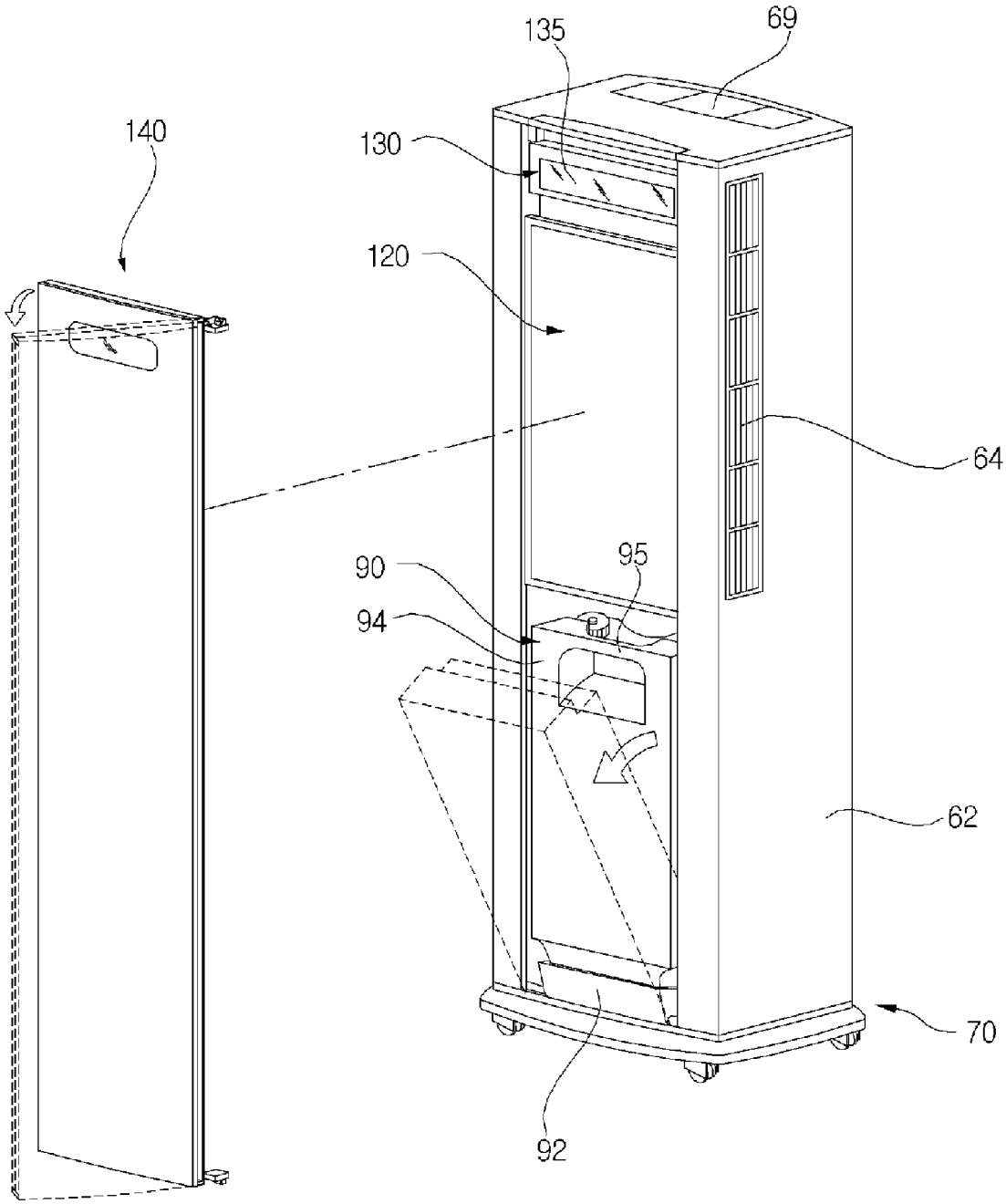

[Fig. 11]
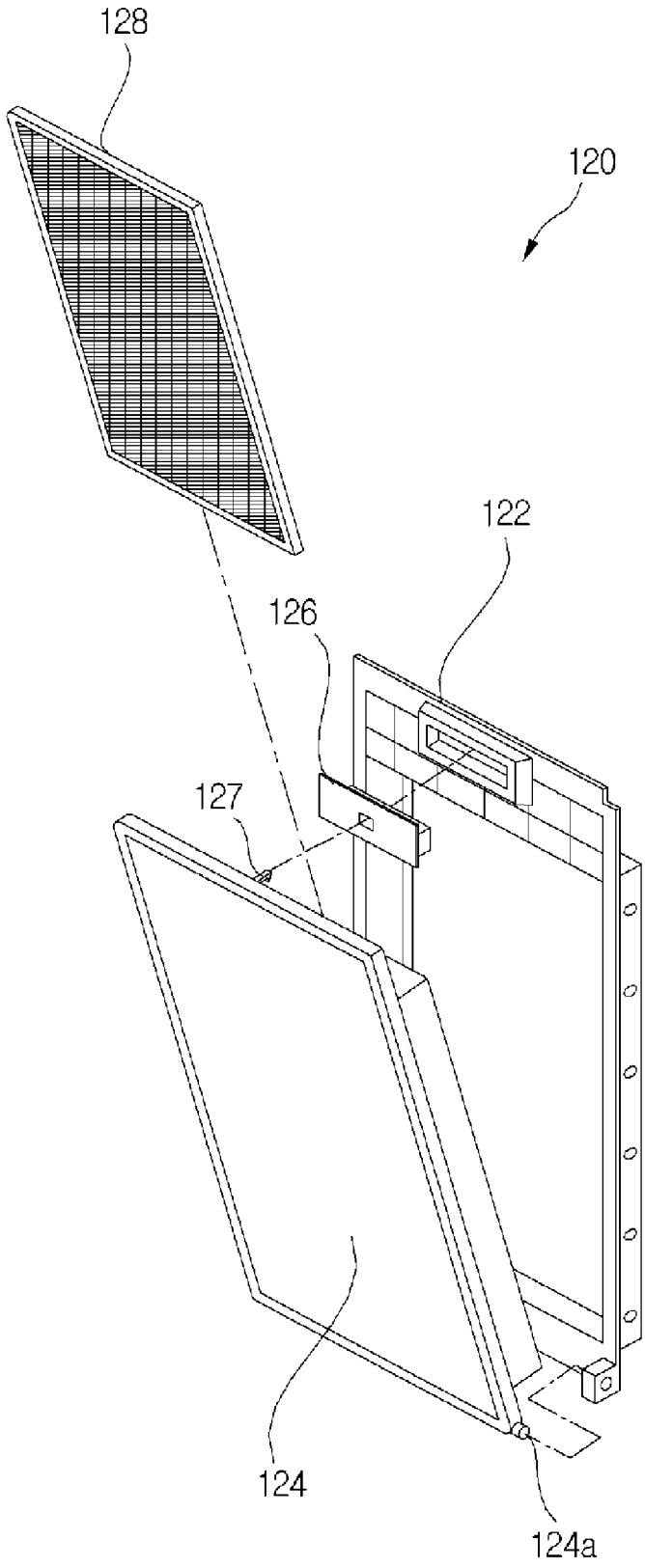

[Fig. 12]
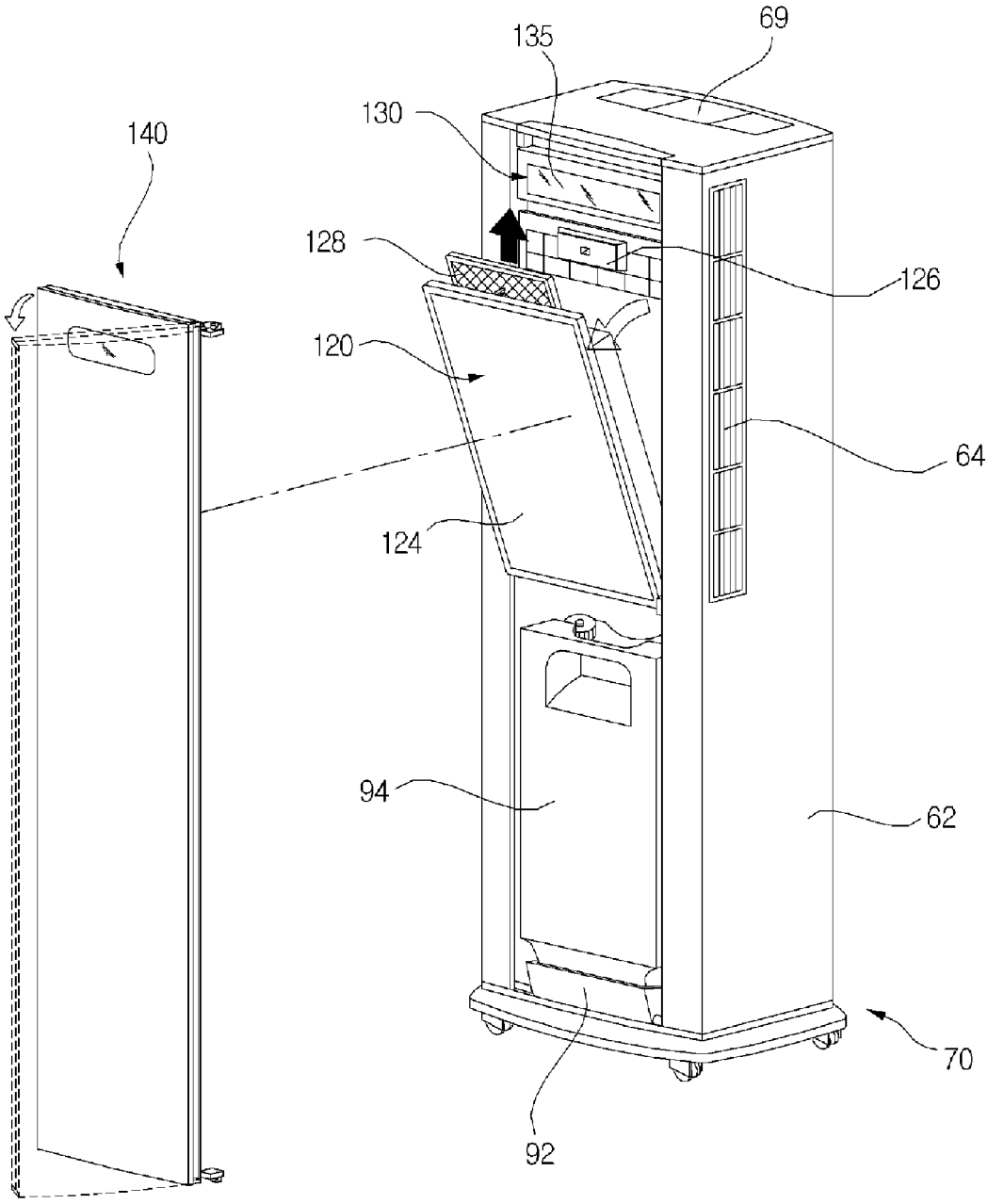

[Fig. 13]
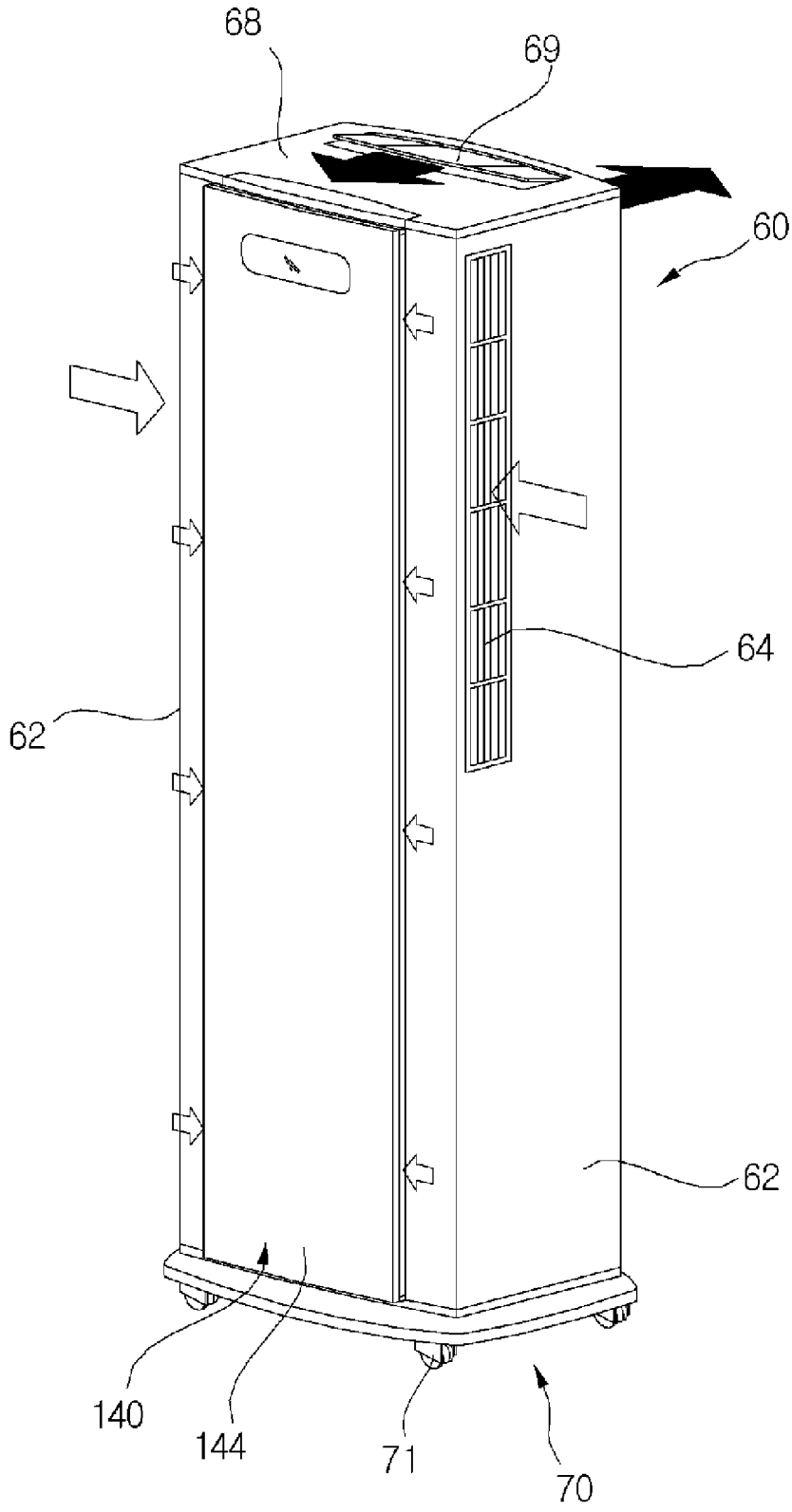

[Fig. 14]
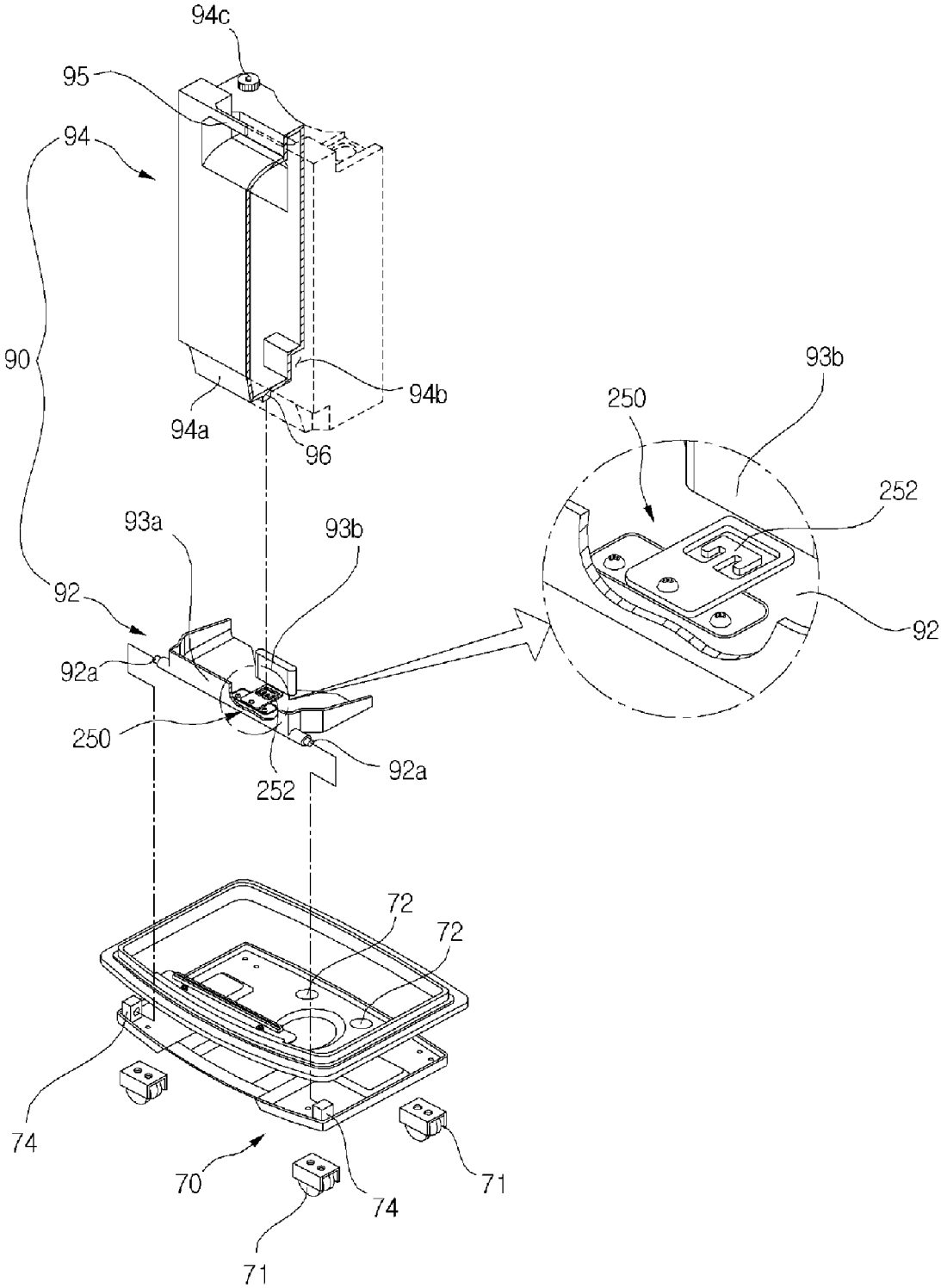

[Fig. 15]
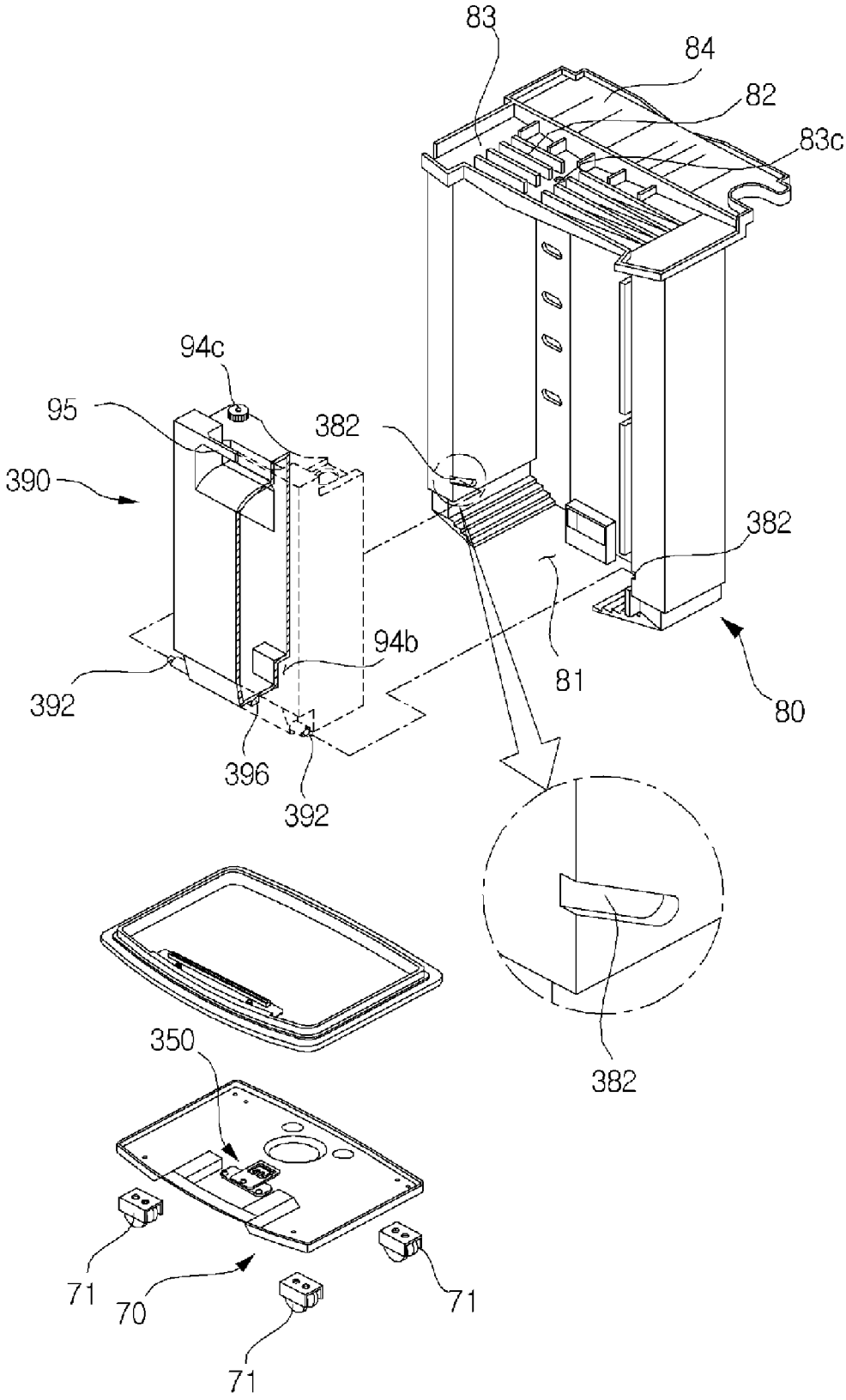

[Fig. 16]
(a)
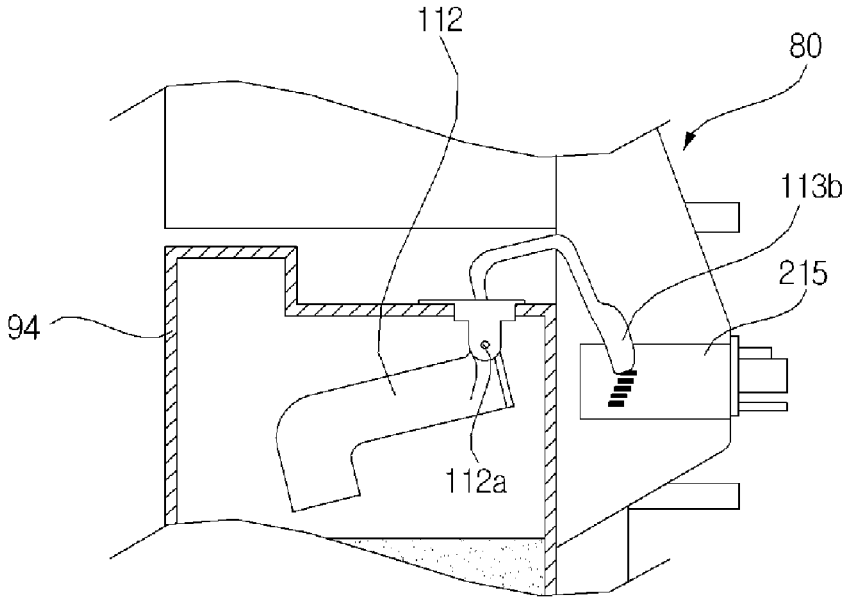
(b)
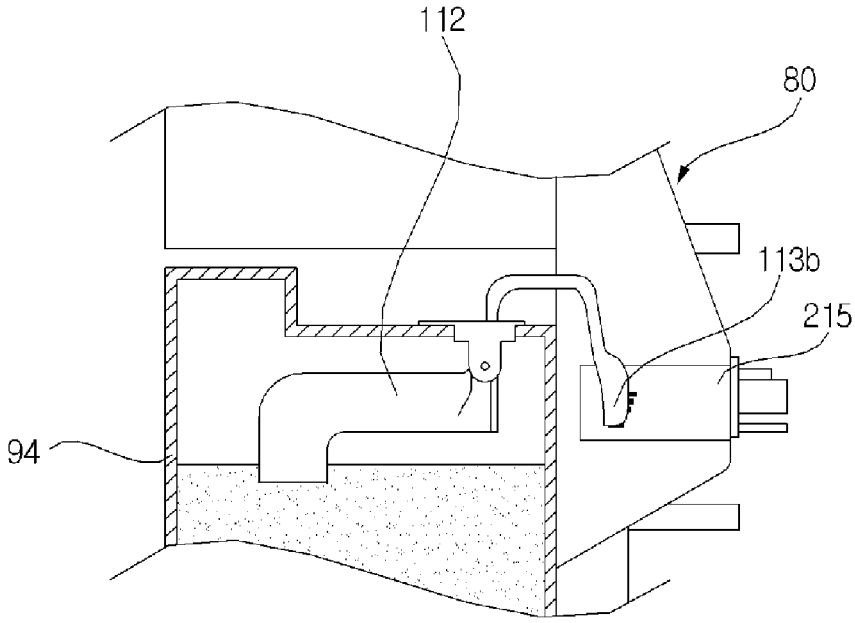

[Fig. 17]
(a)
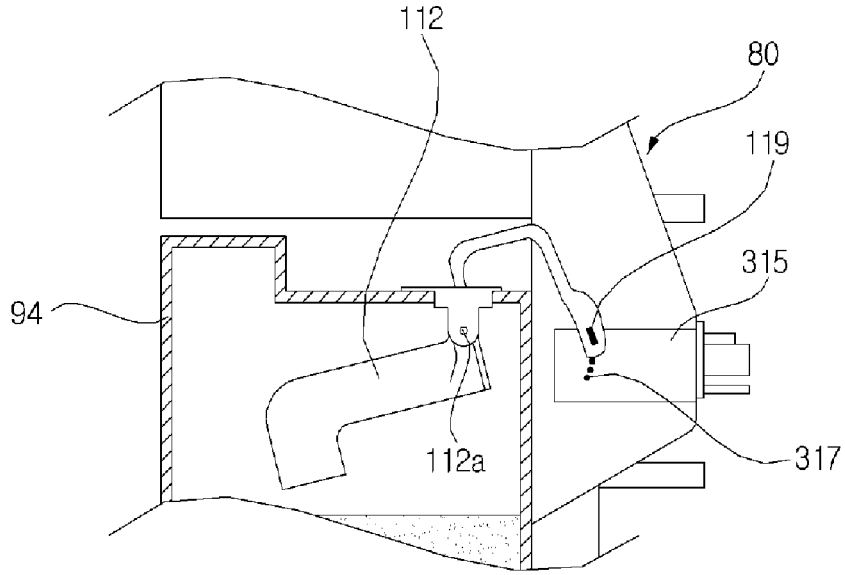
(b)
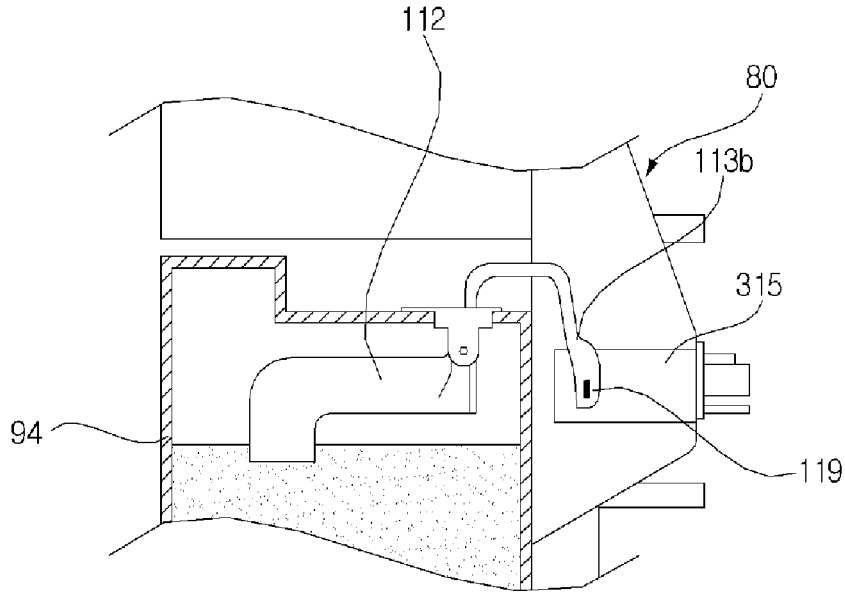

DEHUMIDIFIER

This application is a national phase entry of PCT Application No. PCT/KR2006/004346, filed Oct. 24, 2006, and claims the benefit of Korean Patent Application No. 10-2005-0100257, filed Oct. 24, 2005 and Korean Patent Application 10-2006-007324, filed Jan. 24, 2006; each of the above-identified applications is incorporated by reference hereto in their entireties.

TECHNICAL FIELD

The present invention relates to a dehumidifier, and more particularly, to a dehumidifier that can detect an amount of condensed water stored in a bucket.

BACKGROUND ART

Generally, a dehumidifier is an apparatus for sucking indoor humid air into a cabinet, removing moisture from the humid air by allowing the humid air to pass through a heat exchanger having a condenser and a vaporizer along which refrigerants flow, then discharging the air from which the moisture is removed to an indoor room.

The humidifier includes a cabinet defining an outer appearance, a compressor installed in the cabinet and compressing refrigerants, a condenser for condensing the refrigerants compressed by the compressor by heat-exchanging the refrigerants with air, an expansion valve for expanding refrigerants condensed by the condenser, and a vaporizer for vaporizing the refrigerants expanded by the expansion valve by heat-exchanging the refrigerants with air, and a blower fan for forcedly directing the air into the cabinet.

With the above structure of the conventional dehumidifier, when the blower fan operates, the indoor air is sucked into the cabinet. The sucked air passes through the vaporizer. Then, the moisture contained in the air is condensed on a surface of the vaporizer, thereby removing the moisture from the indoor air. Then, the air whose moisture is removed is discharged out of the cabinet. During this process, the condenser water is stored in a bucket disposed in the cabinet and the user periodically empties the bucket.

However, in the conventional dehumidifier, the user has to identify by himself/herself an amount of the condensed water stored in the bucket.

If the user cannot identify the bucket fully filled with the condensed water or if the user cannot quickly empty the bucket fully filled with the condensed water, the condensed water stored in the bucket may overflow.

DISCLOSURE OF INVENTION

Technical Problem

Accordingly, the present invention is directed to a dehumidifier that substantially obviates one or more problems due to limitations and disadvantages of the related art.

An object of the present invention is to provide a dehumidifier that can detect an amount of level of the condensed water stored in a bucket.

Another object of the present invention is to provide a dehumidifier that can allow the user to empty a bucket in advance the bucket is fully filled with the water by letting a user to visually identify the water level of the condensed water filled in the bucket.

Still another object of the present invention is to provide a dehumidifier having a bucket that can be easily handled so that the user can easily empty the bucket.

Technical Solution

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dehumidifier including: a cabinet defining an outer appearance; a barrier installed in the cabinet to collect condensed water removed from air; a bucket assembly for storing the condensed water directed from the barrier; and a condensed water detecting unit for detecting an amount or level of the condensed water stored in the bucket assembly.

In another aspect of the present invention, there is provided a dehumidifier including: a base defining a bottom of the dehumidifier; a barrier installed on the base to collect condensed water removed from air; a bucket assembly for storing the condensed water directed from the barrier; a weight detecting unit for detecting an amount of the condensed water stored in the bucket assembly; and a display unit for displaying an amount or level of the condensed water, which is detected by the weight detecting unit.

In still another aspect of the present invention, there is provided a dehumidifier including: a base defining a bottom of the dehumidifier; a barrier installed on the base to collect condensed water removed from air; a bucket assembly for storing the condensed water directed from the barrier; a level detecting unit for detecting a water level of the bucket assembly by contacting the condensed water stored in the bucket assembly; and a display unit for displaying the water level detected by the water level detecting unit.

ADVANTAGEOUS EFFECTS

According to the present invention, since an amount or level of the condensed water stored in the bucket by a level detecting unit or a weight detecting unit and a detected result is displayed on the display unit, the user can easily identify the amount or level of the condensed water stored in the bucket.

In addition, since the level of the condensed water stored in the bucket is visually transmitted to the user, the user can remove the condensed water out of the bucket before the bucket is fully filled with the condensed water.

Furthermore, since the weight detecting unit is installed on a bucket guide or a base to which load of the condensed water is directly transmitted, the measuring error can be minimized.

In addition, since the rotation of the floater connected to the bucket by a hinge is detected by a detecting unit installed on a barrier, an amount of the condensed water can be accurately detected.

Meanwhile, since the bucket assembly storing the condensed water is designed to pivot frontward of the barrier, the drain of the condensed water can be easily realized.

Furthermore, since a lower portion of the bucket assembly is designed to pivot, the user can separate the bucket assembly by one motion.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a perspective view of a dehumidifier according to an embodiment of the present invention;

FIG. 2 is an exploded perspective view of the dehumidifier of FIG. 1;

FIG. 3 is an exploded perspective view of a bucket assembly according to an embodiment of the present invention;

FIG. 4 is a partly cut, perspective view of an operation state of a weight detecting unit according to an embodiment of the present invention;

FIG. 5 is a front view of a front panel assembly displaying a weight of condensed water according to the operation of the weight detecting unit according to an embodiment of the present invention;

FIG. 6 is a perspective view of a barrier according to an embodiment of the present invention;

FIG. 7 is a perspective view of a water level detecting unit according to an embodiment of the present invention;

FIG. 8 is an exploded perspective view of the water level detecting unit of FIG. 7;

FIG. 9 is a view illustrating an operation state of the water level detecting unit of FIG. 7;

FIG. 10 is an operational view for illustrating a separating process of the bucket assembly according to an embodiment of the present invention;

FIG. 11 is an exploded perspective view of a filter assembly according to an embodiment of the present invention;

FIG. 12 is an operational view for illustrating a separating process of the filter assembly of FIG. 11;

FIG. 13 is a view illustrating an operation of the dehumidifier of the present invention;

FIG. 14 is an exploded perspective view of a bucket assembly according to a second embodiment of the present invention, illustrating a weight detecting unit;

FIG. 15 is an exploded perspective view of a bucket assembly according to a third embodiment of the present invention, illustrating a weight detecting unit;

FIG. 16 is a view illustrating an operation of a level detecting unit according to a fourth embodiment of the present invention; and FIG. 17 is a view illustrating a level detecting unit according to a fifth embodiment of the present invention.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIG. 1 is a perspective view of a dehumidifier according to an embodiment of the present invention and FIG. 2 is an exploded perspective view of the dehumidifier of FIG. 1.

Referring to FIGS. 1 and 2, a humidifier of the present invention includes a cabinet 60 defining an outer appearance, a compressor 10 installed in the cabinet 60 and compressing refrigerants, a condenser 20 for condensing the refrigerants compressed by the compressor by heat-exchanging the refrigerants with air, an expansion valve 30 for expanding refrigerants condensed by the condenser 20, and a vaporizer 40 for vaporizing the refrigerants expanded by the expansion valve 30 by heat-exchanging the refrigerants with air, and a blower fan assembly 50 for forcedly directing the air into the cabinet.

The dehumidifier of the present invention further includes a base 70 formed a bottom of the cabinet 60, a barrier 80 vertically installed on the base 70 and dividing the base into front and rear portions, a bucket assembly 90 installed on the barrier 80 to store the condensed water condensed on a surface of the vaporizer, and a filter assembly installed on an upper portion of the barrier 80 to filtering off foreign off foreign objects contained in air introduced into the cabinet 60 and directed to the blower fan assembly 50.

Describing in more detail, wheels 71 are installed on a bottom of the base 70 and the barrier 80 is installed on the base 70. With reference to the barrier 80, the bucket assembly 90 is installed on the front portion of the base 70 and the compressor 10 is installed on the rear portion of the base 70.

In addition, the filter assembly, vaporizer 40, condenser 20, and blower fan assembly 50 are installed o the barrier 80 from the front portion to the rear portion in this order.

Here, the vaporizer 40 and the condenser 20 are spaced apart from each other and integrally coupled to each other. In order for the condensed water condensed by the vaporizer 40 to be effectively collected at the barrier 80, a drain pan 83 is formed on a top surface of the barrier 80. The vaporizer 40 and the condenser 20 are mounted on the drain pan 83.

Furthermore, an installation unit 84 formed at a higher location that the drain pan 83 is formed on the top surface of the barrier 80 and the blower fan assembly 50 is mounted on the installation unit 84.

The blower fan assembly 50 includes a housing 52 installed on the barrier 80, a centrifugal pan 54 installed in the housing 52, a driving motor 55 for driving the centrifugal pan 54, and a housing cover 56 assembled with the housing g52 to guide air discharged from the centrifugal pan 54.

The housing 52 is provided with an air inlet 52*a* through which the air is sucked. The air accelerated by the centrifugal pan 54 after passing through the air inlet 52*a* is guided upward by the housing 52 and the housing cover 56.

The housing 52 divides an interior of the cabinet into front and rear portions so that the air introduced from the interior room can be directed to the centrifugal pan 54 through only an air inlet 52*a*.

Furthermore, the vaporizer/condenser 40/20 and the housing 52 are assembled with each other, and a control box 130 for controlling the humidifier is installed above the vaporizer/condenser 40/50 and the housing 5.

Meanwhile, the cabinet 62 includes a side panel 62 defining a side appearance, a rear panel 65 defining a rear appearance, a top panel 68 defining a top appearance, and a front panel assembly 140 defining a front appearance.

The side panel 62 is provided with an inlet through which the air is introduced. The rear and front panels 65 and 68 are provided with respective air outlet 66 and 68*a* through which the air is discharged.

A louver 64 for controlling an induction direction of the air is installed in the inlet 63 of the side panel 62 and louvers 67 and 69 for controlling a discharging direction of the air are installed in the respective outlets 66 and 68*a* of the top panel 68.

Here, the louvers 64 and 67 installed on the respective side and rear panels 62 and 66 are designed to be adjusted by a user. The louver 69 installed on the panel 68 is designed to be controlled by a controller or the user.

At this point, the louver 69 is connected to the top panel 68 by a fin 69*a* so that it can pivot upward and downward. A motor (not shown) or a power transmission mechanism (not shown) may be installed on the top panel 67 so that the louver 69 can pivot by the control unit.

Meanwhile, the front panel assembly 140 includes a front frame 142 connected to the side panel 62 to pivot frontward, and a front panel 144 installed on a front surface of the front frame 142 so that it can be exposed to the user.

The peripheries of the front panel 144 and the front frame 142 are spaced apart by a predetermined distance. Therefore, the indoor air can be introduced into the cabinet 60 through a gap formed between the peripheries of the front panel 144 and the front frame 142.

A panel guide 146 is interposed between the front panel 144 and the front frame 142 at upper and lower ends.

In order for the air flows toward the filter assembly disposed in rear of the front frame 142, the front frame 142 is provided with a plurality of holes 142*a* and slits 142*b*.

Furthermore, a bracket 145 is installed on an edge of the front frame 142 so that the front frame 142 can be connected to the side panel 62 by a hinge. The bracket 145 is formed at each of upper and lower ends of the side edge of the side panel 62 so that the front panel assembly 140 can be opened and closed in a hinge motion.

The following will describe the bucket assembly 90 according to an embodiment of the present invention.

FIG. 3 is an exploded perspective view of the bucket assembly.

Referring to FIG. 3, the bucket assembly 90 of this embodiment includes a bucket guide 92 hingedly connected to the base 70 to pivot frontward and a bucket 94 storing the condensed water and pivoting frontward together with the bucket guide 92.

That is, a pin-shaped hinge 92*a* protrudes from both ends of the bucket guide 92 and is coupled to the bracket 74 of the base 70. Therefore, the bucket guide 92 can pivot about the hinge 92*a*.

The bucket guide 92 includes first and second guide units 93*a* and 93*b* protruding upward to guide the accurate seating of the bucket 94.

Here, the first guide unit 93*a* is aligned with a groove 94*a* formed on a front-lower end of the bucket 94 and the second guide unit 93*b* is aligned with a groove 94*b* formed on a rear surface of the bucket 94.

The guide units 93*a* and 93*b* allows a water collecting hole (83*c* of FIG. 5) of the barrier 80 to be accurately aligned with an inflow hole 94*c* of the bucket 94.

In addition, a handle 95 is formed on an upper end of the bucket 94 so that the user uses the handle 95 when he/she intends to lift the bucket 94.

Therefore, when the user pulls frontward the handle 95 of the bucket 94, an upper end of the bucket 92*a* is pivoted frontward about the hinge 92*a*. Then, after the upper end of the bucket 94 moves out of a receiving portion (81 of FIG. 5) of the barrier 80, the user lifts the bucket 94 so that the bucket 94 can be completely separated from the bucket guide 92.

Here, although now shown in the drawing, the bucket guide 92 may be installed to be hingedly coupled to the barrier.

Meanwhile, a weight detecting unit 150 for detecting the weight of the condensed water stored in the bucket 94 is installed on a lower portion of the bucket 94.

That is, the weight detecting unit 150 includes a load cell that is a kind of weight detecting sensors. The load cell 152 is installed on a lower portion of the bucket guide 92.

The bucket guide 92 is provided with a flexible member 154 for transmitting the load to the load cell 152. The bucket 94 is provided with a protruding portion 96 protruding downward. Therefore, as the flexible member 154 is bent downward by being pressed by the protruding portion 96 of the bucket 94, the load is transmitted to the load cell 154.

Here, the flexible member 154 is integrally formed with the bucket guide 92 and has a first end 154*a* having a flat surface placed on a plane identical to the top surface of the bucket guide 92. When the flexible member 154 is pressed by the protruding portion 96, it is bent as a second of the flexible member 154 moves upward and downward.

In addition, the flexible member 154 has an area larger than the protruding portion 96 so that it can effectively contact the protruding portion 96.

Particularly, the flexible member 154 is provided to reduce the rigidity thereof so that it can largely bent according to the load of the bucket 94. A rib 156 is formed on an inner surface of the flexible member 154 to provide proper elastic force to the flexible member 154.

In addition, the hole 155 and rib 156 can provide a thickness reduction effect for easily forming the shape of the flexible member 154 during the manufacture of the bucket guide 92.

Here, the load cell 152 is a device that can numerically display the weight. That is, when the load is applied, the road cell 152 detects deformation generated while contraction and expansion by the load as an electric signal and transmits the electric signal. Therefore, the load cell 152 detects the load applied from the flexible member 154 and transmits a data value to the control unit. The control unit calculates the data value to convert the same into weight unit.

Here, a location alignment of the flexible member 154 and the protruding portion 96 is realized by the guide units 93*a* and 93*b* formed on the bucket guide 92 and the grooves 94*a* and 94*b* of the bucket 94.

Meanwhile, a water level detecting unit (110 of FIG. 2) may be further installed on the bucket assembly 90 to detect the water level of the bucket 94. The water level detecting unit 110 will be described with reference to the accompanying drawings later.

FIG. 4 is a partly cut, perspective view of an operation state of the weight detecting unit and FIG. 5 is a front view of the front panel assembly displaying a weight of condensed water.

Referring to FIGS. 4 and 5, the condensed water collected through the drain pan 83 is stored in the bucket 94. As an amount of the condensed water increases, the weight (load) of the bucket 94 increases.

As described above, when the amount of the condensed water stored in the bucket 94 increases, the protrusion portion 96 of the bucket 94 transmits the load of the bucket 94 and the condensed water via the flexible member 154. Then, the flexible member 154 is bent downward to transmit the load to the load cell 152 and the load cell 152 transmits the data value to the control unit according to the load transmitted through the flexible member 154.

Then, the control unit calculates the data value transmitted through the load cell 152 to calculate the weight of the condensed water stored in the bucket 94. Then, the water level of the bucket 94 is calculated according to the calculated weight of the condensed water. The calculated water level is displayed on the display unit 135.

Then, the user can identify the amount of the condensed water stored in the bucket 94 through the graph or number displayed on the display unit 135.

Since the user identifies the water level in advance, the user can empty the bucket 94 storing the condensed water, when, for example, he or she intends to leave home for a long time. Therefore, a case where the dehumidifier is not operated due to the bucket fully filled with the condensed water can be prevented.

Meanwhile, the display unit 135 turns on LEDs 135 divided into a predetermined number of levels according to the weight of the condensed water so that the user can identify the water level of the bucket 94.

Alternatively, the display unit 135 can display the water level of the bucket 94 as a percent-unit with reference to 100% (representing that the bucket 94 is fully filled with).

In addition, the control unit calculates a time taken for fully filling the bucket 94 with the condensed water by calculating a storing speed of the condensed water in the bucket 94 and displays the time taken for fully filling the bucket 94 with the condensed water from now.

FIG. 6 is a perspective view of the barrier of the present invention.

Referring to FIG. 6, the barrier 80 of this embodiment includes a receiving portion 81 for receiving the bucket assembly 90, a drain pan 83 formed on an upper portion to collect the condensed water, an installation portion 84 formed in rear of the drain pan 83 to support the blower fan assembly 50.

That is, a water collection hole 83*c* through which the condensed water collected in the drain pan 83 is directed to the inflow hole 94*c* of the bucket 94. Here, the water collection hole 83*c* is formed at a location corresponding to the inflow hole 94*c* of the bucket 83.

In addition, the drain pan 83*c* is provided with a plurality of ribs 82 for guiding the condensed water collected in the drain pan 83 to the water collecting hole 83*c*.

FIG. 7 is a perspective view of the water level detecting unit according to an embodiment of the present invention, FIG. 8 is an exploded perspective view of the water level detecting unit, FIG. 9 is a view illustrating an operation state of the water level detecting unit.

Referring to FIGS. 7 through 9, the water level detecting unit 110 according to this embodiment includes a floater 112 moving in response to the water level of the bucket 94, a holder hingedly connected to the floater 112, a gauge rotating by a predetermined angle in response to the movement of the floater 112, a detecting unit 115 for detecting a position signal of the gauge 114 and transmitting the detected position signal to the control body 130, and an elastic member biasing the gauge 114 to the floater 112.

The bucket 94 is provided at an upper portion with a hole (94*d* of FIG. 3) in which the floater 112 is inserted. The floater 112 is provided with a hinge shaft 112*a* inserted in the hinge hole 98*a*.

Therefore, the floater 112 disposed in the bucket 94 moves upward downward while pivoting by a predetermined angle by the condensed water.

Meanwhile, the floater 112 has a first end 113*a* contacting the condensed water stored in the bucket 94 and a second end 113*b* exposed out of the bucket 94 and contacting the gate 114.

Particularly, the second end 113*b* of the floater 112 moves upward when a relatively small amount of condensed water is stored in the bucket 94 and moves downward when a relatively large amount of the condensed water is filled in the bucket while pivoting about a hinge haft 112*a*, thereby pivoting the gauge 114 pivot.

Therefore, the gauge 114 and the detecting unit 115 that rotate in response to the movement of the floater 112 are separated from the bucket 94. In this embodiment, the detecting unit 115 and the gauge 114 are installed on the barrier 80.

Electronic components for detecting the rotational angle of the gauge 114 are installed in the detecting unit 115. The gauge 114 is rotatably installed on the detecting unit 115 and the elastic member (not shown) is installed on the rotational shaft 117 of the gauge 114 to support the gauge 114.

Here, the gauge 114 has a first end 114*b* contacting the floater 112 and a second end 114*a* contacting one of electrodes 115*a* of the detecting unit 115.

Especially, since the gauge 114 rotates about the rotational shaft 117, the rotational angle of the second end 114*a* rotating about the rotational shaft 117 can be increased even when the amount of the movement of the floater 112 is small.

In addition, the detecting unit 115 is provided to detect the rotational angle of the gauge 114 rotating in response to an amount of the condensed water stored in the bucket 94. That is, the detecting unit 115 transmits a signal corresponding to the amount of the condensed water to the control box 130 in response to the current generated by the contacting of the second end 114*a* of the gauge 114 with the electrode 115*a* installed on the detecting unit 115.

Therefore, the detecting unit 115 is connected to the control box 130 through an electric wire (not shown).

In addition, although not shown in the drawing, an electrode is formed on the rotational shaft 117 installed on the gauge 114 so that the amount of the condensed water can be indirectly measured as the rotational shaft rotates.

In addition, a torsion spring is installed on the rotational shaft 117 to bias the gauge 114 pushed by the floater 112, thereby preventing the gauge 114 from being excessively pushed by the floater 112 and thus improving the measurement accuracy of the condensed water.

Here, in order for the elastic member to be effectively compressed by the second end 113*b* of the floater 112, it is preferable that the elastic force of the elastic force of the elastic member is less than the buoyancy generated by the floater 112.

The following will describe the operation of the water level detecting unit 110.

First, the condensed water condensed by the vaporizer and collected in the drain pan 83 is directed into the bucket 94 through the water collection hole 83*c* of the drain pan 83.

Here, since the water level of the bucket 94 cannot be measured before a pre-determined amount of condensed water is stored in the bucket 94. Therefore, before a predetermined amount of condensed water is stored in the bucket 94, the water level of the bucket 94 is detected by the weight detecting unit 150.

When the bucket 94 is filled with the condensed water above a predetermined level, the floater 112 installed in the bucket 94 floats by the condensed water while pivoting about the hinge shaft 112*a*.

The second end 113*b* of the floater 112, which is positioned out of the bucket 94 contacts the gauge 114 to rotate the gauge 114 counterclockwise and the detecting unit 115 connected to the gauge 114 detects the rotational angle of the gauge 114 and transmits the detected signal to the control body 130.

Here, since the rotational angle of the gauge 114 increases in proportion to the ascended height of the floater 112, the water level detecting unit 110 transmits an actually measured water level rather than a test value to the control body 130.

Then, the control body 130 turns on the LEDs (not shown) of the display unit 135 to let the user know the amount of the condensed water stored in the bucket 94. In addition, when the condensed water is stored in the bucket 94 above a predetermined water level, the water level detecting unit 110 detects this and transmits the detected signal to the control unit. Then, the control unit stops the operation of the compressor 10 to prevent the condensed water from overflowing the bucket 94.

Meanwhile, although not shown in the drawing, the detecting unit 115 of the water level detecting unit 110 or the gauge 114 may be installed to control the power applied from the control body 130 to the compressor 10.

That is, a switch (not shown) may be installed on the gauge 114 or the rotational shaft 117 installed on the gauge 114. When the rotational angle of the gauge 114 is an angle corresponding to a case where the bucket 94 is fully filled with the condensed water, the gauge 114 or the rotational shaft 117 operates the switch to directly cut off the power applied from the control box 130 to the compressor 10.

The following will describe the separating process of the bucket assembly 90.

FIG. 10 is an operational view for illustrating a separating process of the bucket assembly.

Referring to FIG. 10, the user opens the front panel assembly 140 to empty the bucket 94 storing the condensed water. Then, the front panel assembly 140 rotates about the bracket 145 of the side panel 62 to open the cabinet 60.

In addition, the user pulls the handle 95 of the bucket 94 to separate the bucket 94 from the barrier 80.

That is, since the bucket 94 is disposed on the bucket guide 92 and the bucket guide 92 rotates in a state where the hinge 92*a* is connected to the barrier 80, the upper end of the bucket 94 pivots frontward by the user pulling the bucket 94.

As described above, as the user pulls the handle 95 of the bucket 94, the upper end of the bucket 94 is partly removed out of the barrier 80 to a location where the user can effectively lift the bucket 94. That is, when the user lifts the handle 95, the lower end of the bucket 94 is separated from the bucket guide 92.

Therefore, since the bucket 94 can be separated by the user grasping the handle at once, the separation of the bucket 94 can be conveniently realized.

Meanwhile, since the assembling of the bucket 94 is done in a reverse order, the detailed description thereof will be omitted herein.

FIG. 11 is an exploded perspective view of the filter assembly and FIG. 12 is an operational view for illustrating a separating process of the filter assembly.

Referring to FIG. 11, the filter assembly 120 of this embodiment includes a filter frame 122 assembled on the vaporizer 40, a filter case 124 coupled to the filter frame and being capable of pivoting frontward, and a fixing member 126 for fixing the filter case 124 to the filter frame 122.

A filter 128 for filtering off foreign objects contained in the air introduced into the humidifier is slidably installed in the filter case 124. The filter case 124 is pivotally assembled on a lower end of the filter frame 122.

The lower end of the filter case 124 is connected to the lower end of the filter frame 122 by a hinge 124*a*. The filter case 124 is opened while pivoting frontward about the hinge 124*a*.

Here, an elastic member such as a torsion spring is installed on the hinge 124*a* so that the filter case 124 pivots forward when the filter case 124 is separated from the filter frame 122.

In addition, a sliding guide 124*b* is formed on a rear surface of the filter case 124 so that the filter 128 can be slidably mounted in a longitudinal direction. Here, the sliding guide 124*b* is lengthily formed on upper and lower portions of a rear surface of the filter case 124 in a horizontal direction so that the filter 128 can be mounted in or removed from the filter case 124 through a sliding motion.

Meanwhile, the fixing member 126 is installed on the filter frame 122 and the filter case 124 is provided at an upper end with a hook 127 corresponding to the fixing member 126.

Here, the hook 127 is hooked and fixed on the fixing member 126 to fix the filter case 124 to the filter frame 122. This hooking of the fixing member 126 can be realized in a one-though type.

The separating and coupling of the filter assembly 120 will now be described with reference to FIG. 12. The user opens the front panel assembly 140 and separates the filter case 124 from the filter frame 122.

In a state where the filter case 124 is coupled to the filter frame 122, an upper end of the filter case 124 is pressed. Then, the hook 127 is pushed rearward of the fixing member 126 and returned to release the hook fixing state. Therefore, the upper end of the filter case 124 pivots frontward. Then, the filter 128 received in the filter case 124 gets out of the filter case 124.

Meanwhile, when it is intended to couple the filter assembly 120, the filter 128 is inserted in the filter case 124 through the sliding motion. Next, the upper end of the filter case 124 is pushed toward the filter frame 122. Then, the hook 127 is inserted into the fixing member 126 and then hooked and fixed while being pushed by a pre-determined distance frontward.

The following will describe the operation of the humidifier of this embodiment.

FIG. 13 is a view illustrating an operation of the dehumidifier of the present invention.

Referring to FIG. 13, when electric power is applied to the dehumidifier, the control unit installed in the control box 130 applies the power to the blower fan assembly 50 to introduce the indoor air into the cabinet 60 and discharge the introduced air to the room.

At this point, the indoor air is introduced through the air inlet 63 formed in the side panel 62, and the hole 142*a* and slit 142*b* formed in the front frame 142. The introduced air flows to the filter assembly 120 to filter off the foreign objects contained in the air.

Here, the foreign objects of the indoor air passing through the filter assembly 120 are filtered while the air passes through the filter 128. The air passing through the filter 128 is heat-exchanged with the vaporizer 40 after passing through the filter frame 122.

The filtered air heat-exchanges with discharge fins (not shown) formed on the vaporizer 40 and is thus cooled, in the course of which the moisture contained in the air is condensed on the surface of the vaporizer 40. The condensed water on the vaporizer 40 is collected in the drain pan 83 disposed on a lower portion of the vaporizer 40.

In addition, the air cooled while passing through the vaporizer is further heat-exchanged with the condenser 20 installed in rear of the vaporizer 40 to be heated again.

Here, since the condenser 20 emits heat during the condensing process of the vaporized refrigerants, the air from which the moisture is removed is heated to a temperature similar to that of the indoor air during the heat-exchanging process of the condenser 20.

After then, the air passing through the condenser 20 is guided to the housing 52 of the blower fan assembly 50. Then, the air guided into the housing 52 is accelerated by the centrifugal fan 54 installed in the housing 52 to be discharged to the room in a circumferential direction.

As described above, the dehumidifier of this embodiment sucks the air through the front and side surfaces and discharges the air through the top and rear surfaces. Therefore, the air can be directed in an every direction of the room in which the dehumidifier is installed.

Meanwhile, the control unit controls the air discharging direction and an amount of the air discharged by adjusting the rotational angle of the louver 69. Therefore, when the air is discharged upper-frontward of the cabinet 60, the louver 69 rotates rearward from the closed state to form the discharge hole frontward. When the air is discharged upper-rearward of the cabinet, the louver 69 rotates frontward from the closed state to form the discharge hole rearward.

Meanwhile, the condensed water condensed on the vaporizer 40 and collected in the drain fan 83 flows into the bucket 94 through the water collecting hole 83*c* of the drain fan 83.

An amount of the condensed water stored in the bucket 94 is detected by the water level detecting unit 110 or the weight detecting unit 150. The control unit displays the amount of the condensed water in response to the amount of the condensed water stored in the bucket 94.

That is, the weight detecting unit 150 measures the weight of the condensed water and calculate the water level of the bucket 94 using a test formula. The water level is displayed on the display unit 135 so that the user can identify the water level. When the bucket 94 is fully filled with the condensed water, the LEDs (not shown) of the display unit 135 are turned on so as to let the user to know the water discharging timing.

Furthermore, when the condensed water is filled in the bucket above a pre-determined level, the water level detecting unit 110 detects this and transmits the same to the control unit. Then, the control unit stops the operation of the compressor 10 to prevent the condensed water from overflowing the bucket 94.

Here, when the condensed water is filled in the bucket below a predetermined level, the amount of the condensed water will be detected by the weight detecting unit 150. When the condensed water is filled in the bucket above the predetermined level, the amount of the condensed water will be detected by both of the weight detecting unit 150 and the water level detecting unit 110.

At this point, when the amount of the condensed water is detected by both of the weight detecting unit 150 and the water level detecting unit 110, the control unit can compares the amounts detected by the respective weight detecting unit 150 and the water level detecting unit 110. Therefore, the amount of the condensed water stored in the bucket 94 can be accurately detected.

FIG. 14 is an exploded perspective view of a bucket assembly according to a second embodiment of the present invention, illustrating a weight detecting unit.

Referring to FIG. 14, a weight detecting unit 250 of this embodiment is identical to that of the first embodiment except that the flexible member is omitted but only the load cell 252 is installed.

Here, the load cell 252 is installed on a top surface of the bucket guide 92 to directly contact the protrusion 96 of the bucket 94.

Since the operation of the weight detecting unit of the second embodiment is identical to that of the first embodiment, the detailed description thereof will be omitted herein.

FIG. 15 is an exploded perspective view of a bucket assembly according to a third embodiment of the present invention, illustrating a weight detecting unit.

Referring to FIG. 15, this embodiment is identical to the first embodiment except that a bucket of a bucket assembly and a bucket guide are integrally formed and a weight detecting unit 350 is installed on the base of the cabinet.

Here, since the bucket and bucket guide are integrally formed, a hinge 392 is formed on both sides of the lower end the bucket assembly 390 so that the bucket assembly pivots frontward.

The bucket assembly 390 is installed on an inner surface of the barrier 80 and is provided with a groove 382 defining a moving path of the bucket assembly 390. The hinge 392 is installed in the groove 282.

Therefore, the bucket assembly 390 pivots in a state where it seats on the groove 382. When the user intends to separate the bucket assembly 390, the bucket assembly 390 is separated from the barrier 80 while sliding frontward along the groove 382.

Meanwhile, the weight detecting unit 350 is installed on the base 70 such that it contacts the protruding portion 396 of the bucket assembly 390.

Since the operation of the weight detecting unit of the second embodiment is identical to that of the first embodiment, the detailed description thereof will be omitted herein.

FIG. 16 is a view illustrating an operation of a level detecting unit according to a fourth embodiment of the present invention.

Referring to FIG. 16, this embodiment is same as the first embodiment except that the floater 112 detects the water level while the floater 112 directly contacts the detecting unit 215.

That is, an electrode is formed on the detecting unit 215 of this embodiment. A circuit of the detecting unit 215 is coupled to detect the water level as the second end 113*b* of the floater 112.

As described above, when the floater 112 transmits the signal by directly contacting the detecting unit 215, the number of components is reduced and the installation can be easily realized.

Here, although the electrode is formed on the detecting device 215 in this embodiment, it will be also possible to form the electrode on the second end 113*b* of the floater 112.

Since other structures of the fourth embodiment are identical to those of the first embodiment, the detailed description thereof will be omitted herein.

FIG. 17 is a view illustrating a level detecting unit according to a fifth embodiment of the present invention.

Referring to FIG. 17, this embodiment is same as the first embodiment except that the first end 113*b* of the floater 112 is installed on a magnet 119 and the detecting unit 115 detects the magnet 119.

Here, the detecting unit 315 is provided with a hole sensor 317 detecting the magnet 119 and transmits the signal to the control box 130 by the interaction between the magnet 119 and the hole sensor 317 when the magnet 119 moves relatively close to the hole sensor 317.

As described above, the water level detecting device 110 of this embodiment transmits the signal using a non-contact method by the magnet 110 and the hole sensor 317. Therefore, the detection can be realized without contacting the floater 112 with the detecting unit 315. Therefore, the assembling of the components of the water level detecting unit 110 can be easily realized.

Since other structures of the fifth embodiment are identical to those of the first embodiment, the detailed description thereof will be omitted herein.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

According to the dehumidifier of the present invention, the amount of the condensed water stored in the bucket is detected by the water level detecting unit and the weight detecting unit and the detecting amount is displayed on the display unit, the user can easily identify the amount of the condensed water stored in the bucket. In addition, since the level of the condensed water stored in the bucket is visually transmitted to the user, the user can empty the bucket before the bucket is fully filled with the condensed water. Therefore, the industrial applicability of the present invention is very high.

The invention claimed is:

1. A dehumidifier comprising:
a cabinet defining an outer appearance;
a barrier installed in the cabinet to collect condensed water removed from air;
a bucket assembly for storing the condensed water directed from the barrier;
a condensed water detecting unit for detecting a level of the condensed water stored in the bucket assembly; and
a display unit for displaying the level of the condensed water,
wherein the condensed water detecting unit includes:
a floater connected to the bucket assembly by a hinge, wherein the floater rotates about the hinge; and
a detecting unit installed on the barrier, wherein the detecting unit detects a rotational angle of the floater, and wherein the detecting unit is provided with a plurality of electrodes for receiving a signal corresponding to the rotational angle of the floater, and an end of the floater contacts one of the plurality of electrodes, and
wherein the condensed water detecting unit can detect a plurality of levels of the condensed water.

2. The dehumidifier according to claim 1, wherein the condensed water detecting unit further includes a load cell for detecting the weight of the condensed water stored in the bucket assembly.

3. The dehumidifier according to claim 2, wherein the bucket assembly comprises a bucket for storing the condensed water and a bucket guide on which the bucket seats.

4. The dehumidifier according to claim 3, wherein the load cell is installed on the bucket guide and the bucket is provided with a protruding portion contacting the load cell.

5. The dehumidifier according to claim 4, wherein a flexible member supporting the bucket and bent by the load is installed on an upper portion of the load cell.

6. The dehumidifier according to claim 2, wherein the load cell is installed on a base defining a bottom of the cabinet and the bucket assembly is provided at a lower portion with a protruding portion contacting the load cell.

7. The dehumidifier according to claim 1, wherein the floater has a first end disposed in the bucket assembly and a second end disposed out of the bucket assembly.

8. The dehumidifier according to claim 1, wherein the bucket assembly is provided with a hole in which the floater is partly inserted and a holder to which the floater is connected by a hinge is coupled to the hole.

9. A dehumidifier comprising:
a base defining a bottom of the dehumidifier;
a barrier installed on the base to collect condensed water removed from air;
a bucket assembly for storing the condensed water directed from the barrier;
a weight detecting unit for detecting an amount of the condensed water stored in the bucket assembly; and
a display unit for displaying a level of the condensed water,
wherein the weight detecting unit includes a load cell and a control unit calculates a weight of the condensed water stored in the bucket assembly based on data from the load cell, and
wherein the level of the condensed water is calculated based on the calculated weight of the condensed water and the calculated level of the condensed water is displayed by the display unit.

10. The dehumidifier according to claim 9, wherein the load cell is installed on the base and the bucket assembly is provided at a lower portion with a protruding portion contacting the load cell.

11. The dehumidifier according to claim 9, wherein the bucket assembly comprises a bucket guide on which the load cell is installed and a bucket seating on the bucket guide, wherein the bucket stores the condensed water, and wherein the bucket is provided with a protruding portion.

12. The dehumidifier according to claim 11, further comprising a flexible member formed on the bucket guide and bent by the load transmitted by the protruding portion.

13. A dehumidifier comprising:
a base defining a bottom of the dehumidifier;
a barrier installed on the base to collect condensed water removed from air;
a bucket assembly for storing the condensed water directed from the barrier;
a water level detecting unit for detecting a water level of the bucket assembly by contacting the condensed water stored in the bucket assembly; and
a display unit for displaying the water level detected by the water level detecting unit,
wherein the water level detecting unit includes:
a floater connected to the bucket assembly by a hinge, wherein the floater rotates about the hinge; and
a detecting unit installed on the barrier, wherein the detecting unit detects a rotational angle of the floater, wherein a plurality of magnets are installed on the floater and a sensor for detecting the magnets is installed on the detecting unit,
wherein the water level detecting unit can detect a plurality of levels of the condensed water.

* * * * *